United States Patent [19]

Koiso

[11] 4,357,097

[45] Nov. 2, 1982

[54] ELECTROSTATIC RECORDING APPARATUS HAVING A TONER RECOVERING DEVICE

[75] Inventor: Junichi Koiso, Hachioji, Japan

[73] Assignee: Konishiroku Photo Industry Co., Ltd., Tokyo, Japan

[21] Appl. No.: 177,404

[22] Filed: Aug. 12, 1980

[30] Foreign Application Priority Data

Aug. 20, 1979 [JP] Japan ..... 54-105747

[51] Int. Cl.[3] ..... G03G 15/06

[52] U.S. Cl. ..... 355/15; 355/3 DD

[58] Field of Search ..... 355/3 DD, 15; 15/1.5 R, 15/256.52; 430/125

[56] References Cited

U.S. PATENT DOCUMENTS 2,832,311 4/1958 Byrne ..... 355/3 DD X 3,983,841 10/1976 Norton ..... 355/15 X

OTHER PUBLICATIONS

*Research Disclosure;* Dec. 1977; p. 57–58; No. 16448; "Apparatus for Transporting Powdered Materials", by Stewart Probst.

*Primary Examiner*—G. Z. Rubinson

*Assistant Examiner*—Keith E. George

*Attorney, Agent, or Firm*—Jordan B. Bierman; Linda G. Bierman

[57] ABSTRACT

A toner recovery device is provided in an electrostatic recording apparatus through the arrangement of an endless nonmagnetic belt extending about a cylinder mounted coaxially with the drum. The belt moves from the drum to an idler located at the top of a toner supply bin. A blade is provided for scraping toner from the drum into contact with the belt on the cylinder. Magnets mounted about the inside of the cylinder attract the scraped off toner to the belt when it is on the drum. The belt carries the attracted toner from off the drum to the idler in the supply bin. Toner drops from the belt into the supply bin where it is mixed with the toner already therein.

3 Claims, 3 Drawing Figures

ELECTROSTATIC RECORDING APPARATUS HAVING A TONER RECOVERING DEVICE

BACKGROUND OF THE INVENTION

1. Field of the Invention

This invention relates to an electrostatic recording apparatus such as an electrophotographic copying machine etc., and more particularly to apparatus wherein the toner collected in the cleaning device is removed to the developing device so as to be used for a succeeding developing operation.

2. Prior Art of the Invention

An electrostatic recording apparatus such as an electrophotographic copying machine etc. generally requires time and labor for the maintenance, for example, to change the used cleaning web consumed with use or to throw away the toner collected in the cleaning device. However, such regular or irregular maintenance requires substitution expense for the personnel necessary for such maintenance and therefore it has recently become desirable to provide a device which automatically conveys the toner collected in the cleaning device to the developing device.

In order to satisfy such desire, as is shown in Japanese Patent Publication Open-to-Public Inspection No. 45933/1972 for example, a toner recovering device has so far been proposed wherein a bead-chain is arranged between the cleaning device and the toner replenishing tank and the toner collected in the cleaning device adheres to the bead-chain and is conveyed to the toner replenishing tank. However, in such toner recovering device, the toner conveyed by the bead-chain did not surely come off the bead in the toner replenishing tank, and the percentage of the toner that recycled without coming off the bead-chain was large.

SUMMARY OF THE INVENTION

An object of this invention is to propose an electrostatic recording apparatus having a toner recovering device which can recover the collected toner surely and automatically, and it is characterized by that said toner recovering device has a rotatable body which is positioned next to a support capable of forming an electrostatic latent image thereon, in a coaxial manner so that a part of the peripheral surface thereof is exposed to the magnetic brush device of the developing device and is so constructed that magnets are fixedly mounted in the inside peripheral surface thereof. An endless belt extends over said rotatable body in such a manner that a part thereof is guided into the developing device located away from said rotatable body; a conveying means guides the toner collected in the cleaning device toward the belt.

Detailed description of the example of this invention will be given as follows using drawings.

DETAILED DESCRIPTION OF THE PREFERRED EMBODIMENT

Figure 2:
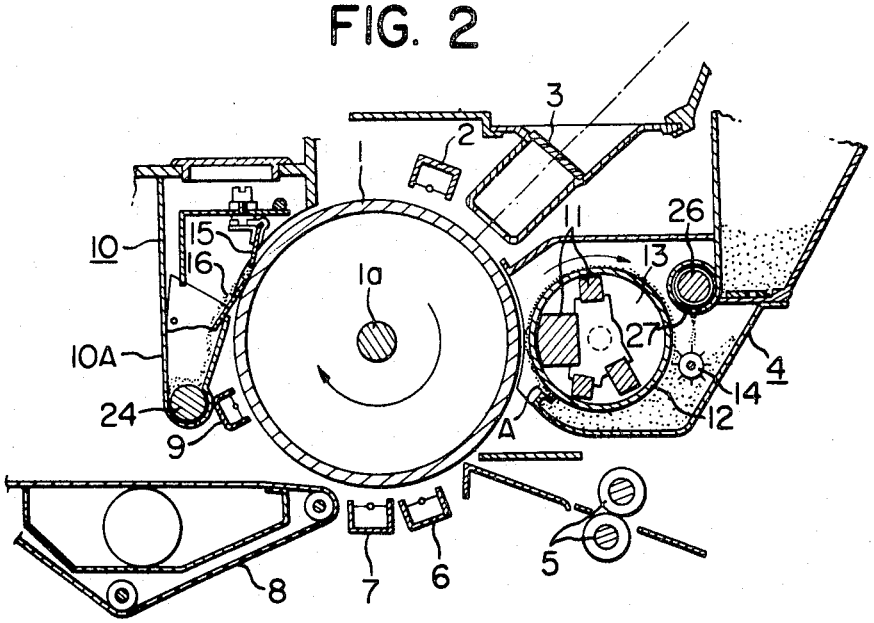
FIG. 2 is a sectional view taken on line II—II of FIG. 1

FIG. 2 is a sectional view showing the elements around the drum 1 having a photoconductive layer (not shown) such as selenium and the like on the surface thereof (referred to as photoconductive drum or drum,) in an electrophotographic copying machine of the type in which this invention is incorporated. Around the photoconductive drum, are provided a charging electrode 2, an optical system (not shown) provided between copy board (not shown) to support an original to be copied and apply the same to the drum at 3, a developing device 4, a pair of paper feeding rollers 5, a transfer electrode 6, a separation electrode 7, a conveying device 8 composed of a plurality of belts, a neutralizing electrode 9 and a cleaning device 10 arranged in the aforesaid order in the direction of rotation of the drum. Developing device 4 is equipped with the magnetic brush device 13 having a rotatable sleeve 12 in which stationary plural permanent magnets 11 are mounted, and with a stirring blade 14. Therefore, when the two-component developer contained in the developing device 4 is stirred by the stirring blade 14, toner included in said developer is charged and with the rotation of the sleeve 12, the ears of the developer in which the magnetic carrier such as iron particles and toner particles are blended, are formed on the peripheral surface of said sleeve.

In this embodiment, the magnets are so arranged that the developer layer formed on the peripheral surface of the sleeve is divided in two sections, one of which serves to develop the latent image on the drum and another one is used for delivering the developer to a rotating body as mentioned hereinafter.

The cleaning device 10 is housed in the container 10A and is equipped with the blade 15 the tip of which lightly contacts the peripheral surface of the photoconductive drum 1, and toner scraped away from the peripheral surface of the drum 1 by the blade 15 is dropped along the guide plate 16 and is piled up on the bottom of the container 10A.

Figure 1:
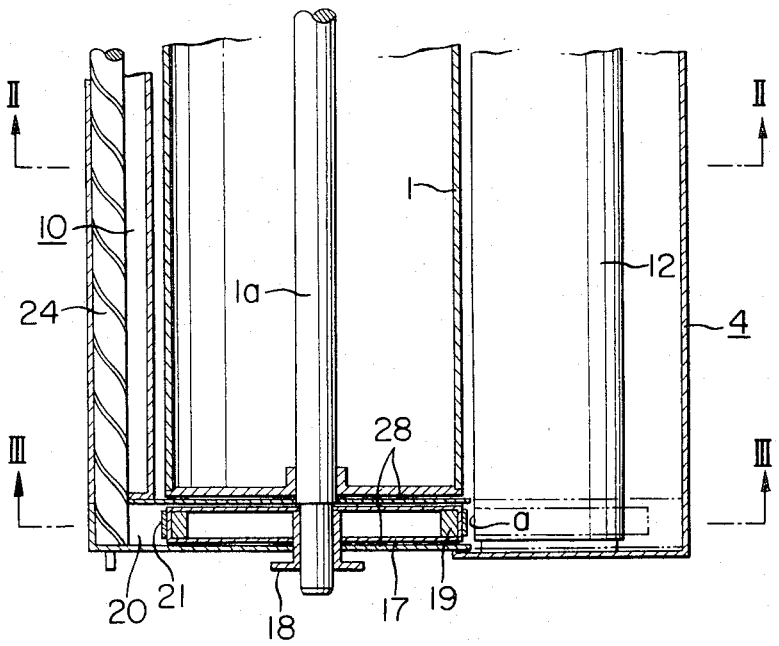
FIG. 1 is a partial sectional view of the photosensitive drum of the copying machine in which this invention is incorporated.
Figure 3:
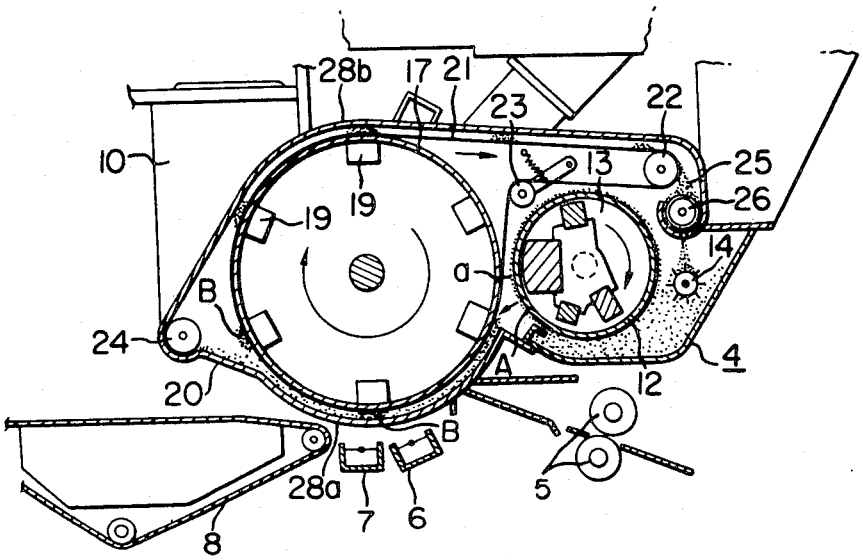
FIG. 3 is a sectional view taken on line III—III of FIG. 1.

In this invention, on the other hand, as is shown in FIG. 1 and FIG. 3, a rotating body or circular member 17 which is made of non-magnetic substance such as aluminum, brass or synthetic resins etc. is provided at one end of and next to aforesaid photoconductive drum 1. The entire rotating body 17 may be made of magnetic material, in which case it is preferable that non-magnetic material is mounted on each side plate thereof. The rotational body 17 is made hollow with a diameter which is nearly the same as that of the drum 1 and is supported on the center axis **1*a* of the drum 1 through the base portion of a sprocket 18 connected to driving mechanism (not shown). In the example shown in the figures, the rotatable body 17 is driven independently without relation to the rotation of the drum 1 by the sprocket 18, but body 17 may be rotated together with the photoconductive drum 1**.

The rotatable body 17 is equipped with plural permanent magnets 19 which are fixed on the internal peripheral surface thereof. The magnetic force of these magnets 19 is greater than that of the magnets which are provided into the sleeve 12 but, it is possible to exclude the magnets in the sleeve. These permanent magnets 19 are arranged with the same interval (even numbered magnets for instance) in the circumferential direction so that their magnetic poles point in the direction of the radii of the rotatable body 17, and the number of magnets to be arranged is decided according to the property of the developer used and the speed of revolution of the body 17. The peripheral surface of the rotatable body 17 is positioned adjacent the peripheral surface a at the end of the sleeve 12 in the developing device 4, and the chute 20 of the cleaning device 10 as mentioned later, and shown in FIG. 1.

About the narrow peripheral surface of said body 17, is provided a narrow endless belt 21 that is made of non-magnetic material such as rubber, cloth, resin film or aluminum foil. In this embodiment, a belt made of etylen-propylen copolymer is used. This endless belt 21 passes over the idler 22 made of synthetic resin and arranged in the tank or bin of the developing device 4 and about a tension roller 23 as is shown in FIG. 3. At the bottom of said cleaning device 10, on the other hand, a screw conveyor 24 that conveys toner scraped from the drum surface by the blade 15 to the one end of the cleaning device 10, is housed and at the delivery end of this screw conveyor 24, the chute 20 that delivers toner to the rotational body 17, is provided. In the aforesaid developing device 4, a second screw conveyor 26 whose inlet 25 is opened under said idler 22, is arranged. The screw conveyor 26 extends parallel to the sleeve 12 and housed in the bending or cover portion (no reference symbol) of a partition wall 28 including the chute 20. This cover portion has plural outlets 27 (as shown in FIG. 2) distributed side by side in the longitudinal direction thereof and therefore; as stated later, the developer (mixture of carrier and toner) taken in from the inlet 25, is recovered evenly in the developing device 4 from the outlets 27. The rotational body 17 and endless belt 21 are housed in the partition wall 28 that has guide sections **28*a* and 28*b* slightly spaced from the adjacent part of the endless belt 21**.

Next, the action of said toner recovering device of the present invention will be described according to FIG. 3.

During an operation of a copying machine, an ear A of the developer is formed on the peripheral surface of the sleeve 12 of the developing device 4 as in the past and this ear is transferred, when the body 17 rotates, to the peripheral surface of the endless belt 21 driven through the friction with the surface of the body 17 by the magnetic force of the permanent magnets 19. Hence, at the plural locations on the surface of the endless belt 21, the ear B of the developer is formed. Therefore, when the ear B of the developer passes the chute 20 with the rotation of the body 17, toner delivered from the cleaning device 10 is absorbed in such ear B, and the ear B of the developer attracted by the magnetic force of the permanent magnets 19 is transferred to the upper part of the body 17. After that, the endless belt 21 and the body 17 separate from one another owing to the difference in the direction of their motion, causing disappearance of the attracting force of the permanent magnet 19 and therefore the developer on the endless belt 21 drops in the inlet 25 of the screw conveyor 26 when it passes the idler 22 and is finally recovered in the developing device 4 through the opening 27, as mentioned above. Thus, recirculation or recovery of the toner is achieved. The developer which is fallen into the inlet 15 may be mixed with the toner for replenishment before fall in the device 4. Toner box is shown at the right side of bending portion of the member 28. Further, the device can be so constructed that some amount of the developer in the device 4 falls in the member, automatically. Furthermore, the recovery device is applicable to the electrostatic recording apparatus wherein one component developer is used, similarly. Each particle of the developer is mainly composed of a resin and a magnetic particle dispersed therein.

As is evident from the above description, toner can surely be recovered in the developing device in this invention since the attraction force for the developer inevitably disappears with the separation of the permanent magnets and the endless belt, and yet the recovered toner will not cause the deterioration of the image because no external force is applied unnaturally to the recovered toner.

What is claimed is:

1. In an electrostatic recording apparatus having a drum, means forming an electrostatic image thereon, a developing device including a supply bin containing toner and means applying said toner to said drum for changing a latent image to a visible image, and cleaning means scraping off residual toner from said drum, the combination of a toner recovery device comprising a hollow rotatable cylinder mounted coaxially with said drum for rotation therewith, a plurality of circumferentially spaced magnets mounted about the inside peripheral surface of said cylinder, an idler spaced from said cylinder and rotatably mounted in said bin above the toner contained therein, an endless belt passing about said cylinder and over said idler, and means directing the toner scraped from said drum into contact with said belt, whereby said scraped toner adheres to said belt where the latter passes about said cylinder, under the attraction of said magnets, and is carried by said belt to said idler and drops into the bin of said developing device.

2. Toner recovery device according to claim 1, in combination with means in said bin distributing the removed toner and mixing the same with toner already in the bin.

3. Toner recovery device according to claim 2, in which a part of the hollow cylinder over which the belt passes is positioned adjacent the means for applying toner to said drum whereby a portion of the toner in the bin is attracted to said belt and becomes mixed with the toner scraped from the drum.

* * * * *